US009933123B2

(12) United States Patent
Ladstätter

(10) Patent No.: US 9,933,123 B2
(45) Date of Patent: Apr. 3, 2018

(54) LIGHT STRIP SYSTEM

(71) Applicant: ZUMTOBEL LIGHTING GMBH, Dornbirn (AT)

(72) Inventor: Gerald Ladstätter, Klaus (AT)

(73) Assignee: ZUMTOBEL LIGHTING GMBH (AT)

( * ) Notice: Subject to any disclaimer, the term of this patent is extended or adjusted under 35 U.S.C. 154(b) by 0 days.

(21) Appl. No.: 15/128,203

(22) PCT Filed: Apr. 27, 2015

(86) PCT No.: PCT/EP2015/059088
§ 371 (c)(1),
(2) Date: Sep. 22, 2016

(87) PCT Pub. No.: WO2015/165853
PCT Pub. Date: Nov. 5, 2015

(65) Prior Publication Data

US 2017/0122509 A1 May 4, 2017

(30) Foreign Application Priority Data

Apr. 28, 2014 (DE) ..... 20 2014 101 986 U

(51) Int. Cl.
*F21V 21/00* (2006.01)
*F21S 8/04* (2006.01)
(Continued)

(52) U.S. Cl.
CPC . *F21S 8/04* (2013.01); *F21S 4/20* (2016.01); *F21V 15/01* (2013.01); *F21V 19/00* (2013.01);
(Continued)

(58) Field of Classification Search
CPC .... F21S 8/04; F21S 4/20; F21V 19/00; F21V 21/025; F21V 31/00; F21V 31/005;
(Continued)

(56) References Cited

U.S. PATENT DOCUMENTS 5,499,170 A 3/1996 Gagne
8,033,677 B1 10/2011 Olsson et al.
(Continued)

FOREIGN PATENT DOCUMENTS

CN 203442630 2/2014
DE 4300549 7/1994
(Continued)

OTHER PUBLICATIONS

Austria Search Report for AU Patent Application GM 220/2014 dated Dec. 9, 2014.
(Continued)

*Primary Examiner* — Alexander Garlen
(74) *Attorney, Agent, or Firm* — Andrus Intellectual Property Law, LLP

(57) ABSTRACT

A light strip system comprises an elongate carrier arrangement formed by mounting rail elements that are open towards the lower face, a shaped part which consists at least partly of a flexible material and forms an accommodation space formed in the carrier arrangement and extending in the longitudinal direction, and a lighting module component arranged in the accommodation space. In order to hold the lighting module component it is arranged so as to push against contact regions of the carrier arrangement, on two opposite sides, each time with the interposition of regions of the shaped part.

15 Claims, 4 Drawing Sheets

(51) Int. Cl.

| | |
|---|---|
| ***F21S 4/20*** | (2016.01) |
| ***F21V 21/02*** | (2006.01) |
| ***F21V 31/00*** | (2006.01) |
| ***F21V 19/00*** | (2006.01) |
| ***F21V 15/01*** | (2006.01) |
| ***F21V 23/00*** | (2015.01) |
| *F21Y 103/00* | (2016.01) |

(52) U.S. Cl.
CPC ..... *F21V 21/025* (2013.01); *F21V 23/002* (2013.01); *F21V 31/005* (2013.01); *F21Y 2103/00* (2013.01)

(58) Field of Classification Search
CPC ..... F21V 23/002; F21V 15/01; F21V 15/013; F21Y 2103/00
See application file for complete search history.

(56) References Cited

U.S. PATENT DOCUMENTS

| | | | | |
|---|---|---|---|---|
| 2006/0028813 | A1* | 2/2006 | Hwang | F21S 8/04 362/223 |
| 2010/0067236 | A1* | 3/2010 | Gassner | F21V 17/02 362/294 |
| 2010/0103657 | A1* | 4/2010 | Teng | F21S 2/005 362/223 |
| 2010/0214770 | A1 | 8/2010 | Anderson | |
| 2011/0083460 | A1* | 4/2011 | Thomas | A47F 3/001 62/264 |
| 2013/0010473 | A1 | 1/2013 | Dellian et al. | |
| 2014/0233228 | A1 | 8/2014 | Komiyama et al. | |
| 2014/0247603 | A1* | 9/2014 | Cruz | F21S 8/033 362/311.01 |

FOREIGN PATENT DOCUMENTS

| | | |
|---|---|---|
| DE | 10025646 | 11/2001 |
| DE | 102006009891 | 9/2007 |
| DE | 102008051481 | 5/2009 |
| DE | 102010003073 | 9/2011 |
| DE | 202012102874 | 6/2013 |
| DE | 102012206013 | 10/2013 |
| DE | 102013205934 | 10/2013 |
| DE | 102012210742 | 1/2014 |

OTHER PUBLICATIONS

PCT Search Report for parent Application PCT/EP2015/059088 dated Sep. 7, 2015.
German Search Report for German Patent Application 20 2014 101 986.3 dated Dec. 6, 2016.

* cited by examiner

LIGHT STRIP SYSTEM

CROSS REFERENCE TO RELATED APPLICATIONS

The present application is the U.S. national stage application of International Application PCT/EP2015/059088, filed Apr. 27, 2015, which international application was published on Nov. 5, 2015 as International Publication WO 2015/165853 A1. The International Application claims priority to German Patent Application 20 2014 101 986.3 filed Apr. 28, 2014.

FIELD OF THE INVENTION

The invention relates to a light strip system with an elongated carrier arrangement, which is formed by mounting rail elements that are open towards the lower face.

BACKGROUND

Such a light strip system is known from the prior art, in which the carrier arrangement comprises several U-shaped mounting rail elements, which are arranged in a row in such a way that they are bordering each other on the end faces in order to form an elongated accommodation space or accommodation channel. The accommodation space can hereby extend over several meters. The mounting rail elements can then be equipped with various light or optics inserts; the equipping of these inserts is typically done by a customer or user of the light strip system. The user thus assembles the desired end product by using a variety of components.

A problem herein is that the thereby created elongated accommodation space does not offer any or at most a very limited protection from dust or moisture. Thus, the light strip system is not really suitable to be used in facilities that are used for industrial purposes, in which typically a correspondingly higher protection class for light strip systems is desired or demanded.

SUMMARY OF THE INVENTION

It is the objective of the invention to specify a correspondingly enhanced light strip system particularly a light strip system better suited for operation in a dusty or moist environment.

This objective is accomplished according to the invention described hereafter.

A light strip system is provided in accordance with the invention, which comprises an elongated carrier arrangement, which is formed by mounting rail elements that are open towards the lower face; the light strip system further comprises a shaped element which comprises, at least partly, a flexible material in order to form an accommodation space that is formed within the carrier arrangement and that extends in the longitudinal direction. The light strip system further comprises a light module component within the accommodation space, whereby in order to hold the light module component, it is arranged so as to push against contacting areas of the carrier arrangement on two opposite sides, by using respective intermediate areas of the shaped element.

By means of the shaped element, it is possible to design the accommodation space, in which the light module component is arranged, in such a way that it is suitably sealed and therefore that it is well protected against dust and moisture. Since the light module component is arranged in such a manner so that it pushes against contact regions of the carrier arrangement on two opposite sides by using a respective intermediate area of the shaped element, it is possible to attach it on the carrier arrangement, so that it rests on it and that it is held particularly well.

Preferably, the light module component is arranged on the shaped element by clamping it via a snap-on connection. In this way, it is particularly simple to attach it to the carrier arrangement.

In a cross-section perpendicular to the longitudinal direction, the accommodation space is preferably designed in a way that it is fully tight. In this way, it possible to achieve particularly well suited protection against dust or moisture for the light module component that is arranged inside the accommodation space.

The contacting areas are preferably formed by means of two ledges of the carrier arrangement that are facing towards each other. In this way it is possible to achieve a particularly well suited transmission of the force for the mounting of the light module component.

The intermediate areas of the shaped element are preferably arranged in such a way that they directly touch the contacting areas of the carrier arrangement. A particularly direct transmission of the force to mount the light module component can be achieved in this way.

The shaped element is preferably attached to the carrier arrangement by means of a snap-on connection and, in particular, only by this snap-on connection. This allows for a particularly simple mounting of the shaped element onto the carrier arrangement.

In order to achieve a particularly well suited mounting of the light module component, the shaped element preferably comprises ledges that face towards the inside. As far as the manufacturing is concerned, it is preferred that these ledges, that are facing towards the inside, are produced by a profiling that is formed onto the shaped element.

In order to achieve a particularly well suited mounting of the shaped element on the carrier arrangement, the shaped element furthermore comprises ledges that face towards the outside, which are preferably designed opposite of the ledges that face towards the inside for a particularly well suited transmission of the force. For the manufacturing, it is advantageous that the ledges, which face towards the outside, are created by means of a further profiling that is formed on the shaped element.

Preferably, the shaped element extends as one piece at least mainly across the length of the mounting rail elements. In this way it is possible to achieve a suitable tightness of the accommodation space along the corresponding length, in particular also throughout a coupling joint that is formed by the mounting rail elements.

Preferably, the light strip system furthermore comprises another shaped element, which is connected to the beforementioned shaped element with a form-fit, in particular in a tightly sealed manner, in order to form the accommodation space, whereby the further shaped element comprises, at least partially, a flexible material. In this way, the accommodation space can be designed in a particularly well suited tight manner and it can be produced in a simple way.

Preferably, the shaped element and possibly preferably also the other shaped element are designed in such a way that they can be rolled up into a reel. In this way, the relevant parts can be easily transported in a particularly simple manner, e.g. to an installation site, even if they have a comparatively great length, e.g. of several meters.

The light module component is preferably e.g. a light module or a cable holder that is bow-shaped in particularly in a cross-section.

According to another aspect of the invention, a lighting system is provided which comprises an elongated carrier arrangement, which is formed by mounting rail elements that are open towards the lower face; the light strip system further comprises a channel-like accommodation space that is formed within the carrier arrangement by means of two shaped elements in order to house light module components. The lighting system can also be a light strip system as it was described above. At least one of the shaped elements is hereby designed in such a flexible manner that, in the case of a temperature-related change of the pressure within the accommodation channel, the pressure change can be at least compensated to the largest degree by an adapting of the shape of the corresponding shaped element.

In this way, the accommodation space can be designed in such a way that it is suitably sealed to such an extent, that basically no dust and moisture can enter. In particular, it can be advantageously provided that the accommodation space is designed in a way that it is completely closed, which includes the two end faces.

BRIEF DESCRIPTION OF THE DRAWINGS

In the following, the invention will be described in greater detail by means of an embodiment and with reference to the drawings. It is shown.

DETAILED DESCRIPTION

Figure 1:
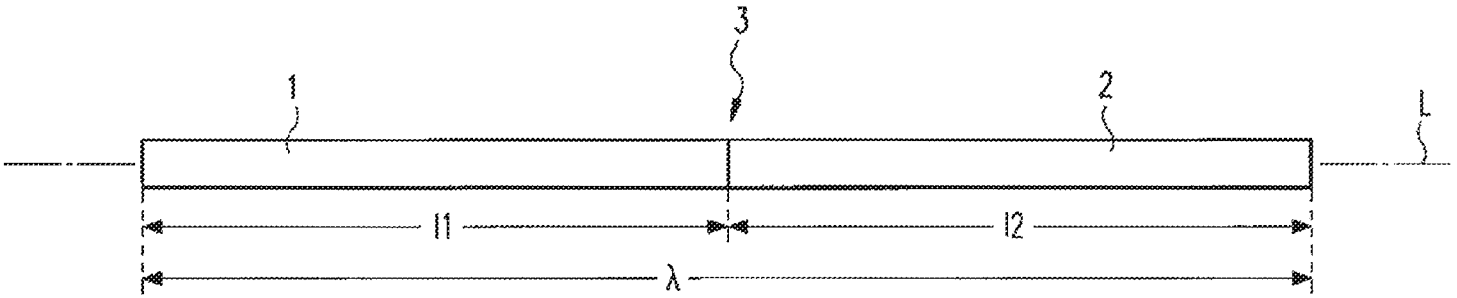
FIG. 1 shows a sketch of a side view of a light strip system according to the invention.

FIG. 1 depicts a sketch of a side view of a light strip system according to the invention. The light strip system features an elongated carrier arrangement which extends along a longitudinal axis L. The carrier arrangement is hereby formed by mounting rail elements 1, 2 that are designed to be open towards the lower face.

The mounting rail elements 1, 2 are preferably made of a sturdy material, e.g. a material like aluminum.

The mounting rail elements 1, 2 are preferably designed with a profile, which respectively extends along the longitudinal axis L; particularly the mounting rail elements 1, 2 of the arrangement feature the same cross-sectional shape respectively.

Hereby, two of the mounting rail elements 1, 2 are preferably arranged in such a way that they adjoin at their end faces via a coupling joint 3. If the arrangement comprises more than two mounting rail elements 1, 2, these mounting rail elements 1, 2 are all arranged in an accordingly adjoined manner. Thus, for the sake of a simplified description, the particular case will be considered wherein the carrier arrangement only comprises the two depicted illustrated mounting rail elements 1, 2 in the following.

The carrier arrangement features an overall length $\lambda$ along the longitudinal axis L, which corresponds to the lengths 11, 12 of the individual mounting rail elements 1, 2.

Figure 2:
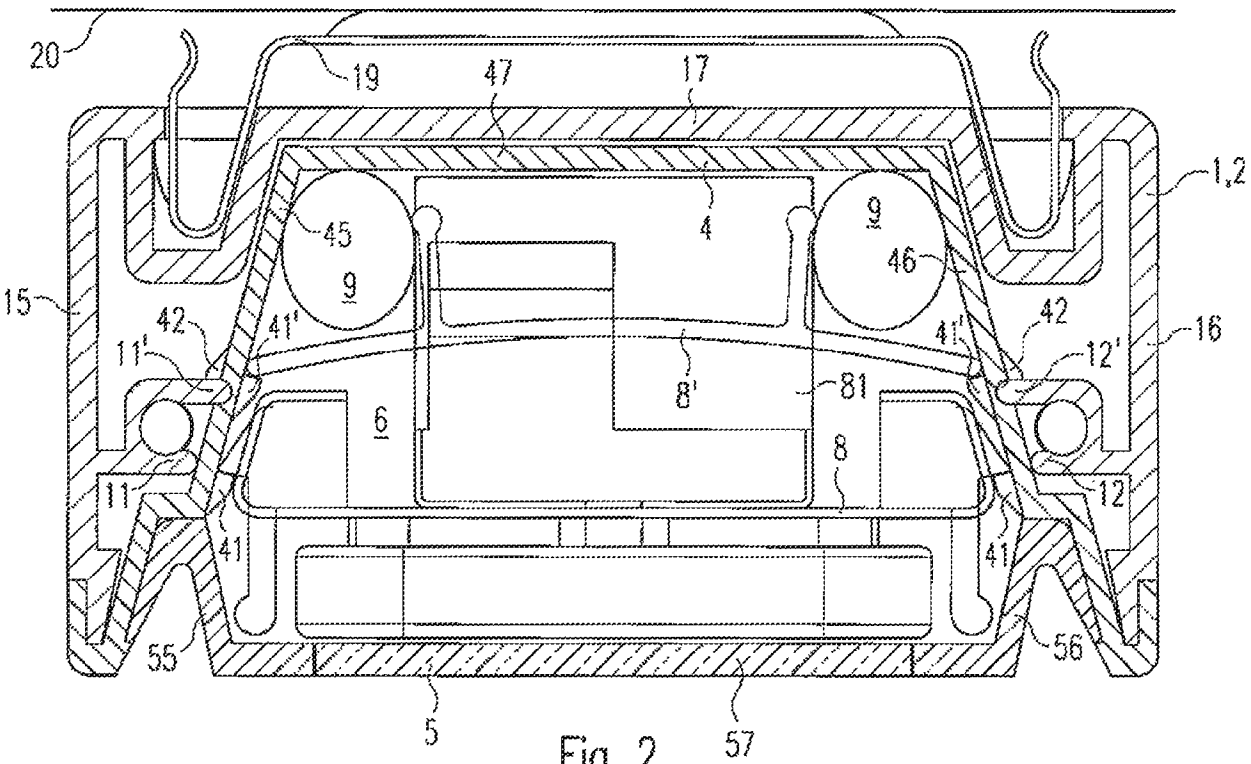
FIG. 2 shows a cross-sectional sketch of the lighting system.
Figure 3:
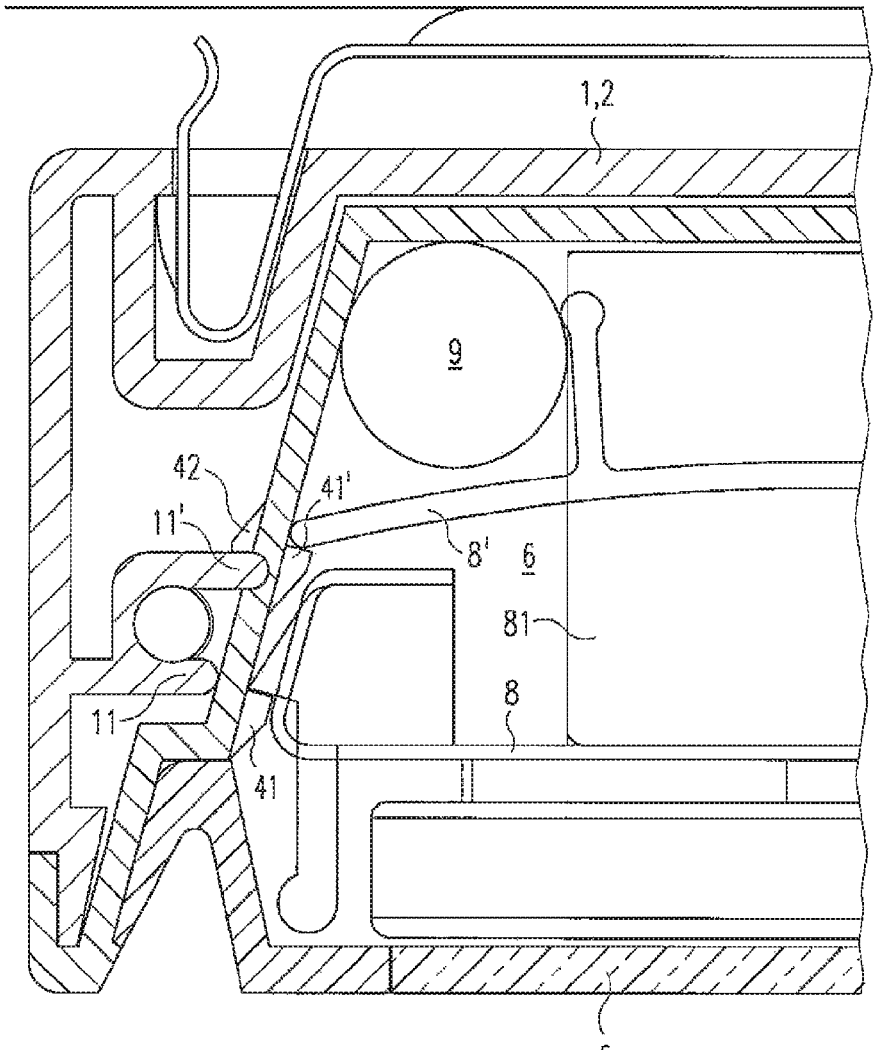
FIG. 3 shows an enlarged section from FIG. 2.

In FIG. 2 a cross-section of the light strip system perpendicular to the longitudinal axis L is outlined. In the depicted example, the mounting rail elements 1, 2 at least partly feature a U-shaped cross-section, so that a first U-bracket 15, a second U-bracket 16 and a connecting bracket 17, which connects the two U-brackets 15, 16 with each other, is formed. The two U-brackets 15, 16 extend, correspondingly, from the two opposite end portions of the connecting bracket 17 downwards.

In order to attach the mounting rail elements 1, 2, e.g. to a ceiling 20, it is possible to provide at least one mounting element, e.g. in form of a fastening spring 19, which is directly attached to the mounting rail elements 1, 2. In the depicted example, the fastening spring 19 reaches and engages into the groves, which are formed at the connecting bracket 17, from above.

The light strip system furthermore comprises a shaped element 4, which is at least partially made of a flexible material, in particular of a material that is more flexible than the mounting rail elements 1, 2. The shaped element 4 is made e.g. of a plastic material.

The shaped element 4 is hereby designed to form an accommodation space 6 within the carrier arrangement, whereby this accommodation space 6 extends parallel to the longitudinal axis L or in a longitudinal direction.

Preferably, the light strip system furthermore comprises another shaped element 5, which is connected to the before-mentioned shaped element 4 with a form-fit and in particular in a tightly sealed manner, in order to form the accommodation space 6; preferably, the further shaped element 5 is thereby also made at least partially of a flexible material.

In the depicted example, the further shaped element 5 sets a limit to the accommodation space 6 on the lower side, while the before-mentioned shaped element 4 sets an upper limit to the accommodation space 6. The design is made in such a way that the accommodation space 6 is fully sealed in a cross-section perpendicular to the longitudinal axis L or to the longitudinal direction.

By means of the form-fit connection, the accommodation space 6 can be formed in a particular well suited tightly sealed manner, in particular since the before-mentioned shaped element 4 and the further shaped element 5 comprise, at least partially, a flexible material. The accommodation space 6 is hereby preferably designed in a way that it is fully sealed against dust and moisture.

A particularly simple assembly can be achieved when the two mentioned shaped elements 4, 5 are connected to each other by means of a snap-on connection and, in particular, only by means of the snap-on connection.

Hereby at least one light module component 8 is particularly arranged in the accommodation space 6; this light module component can refer to e.g. a light module 8 as such. The light module 8 can e.g. comprise an LED-light source (LED: light emitting diode), in particular for a light output that is directed downwards. The further shaped element 5 is correspondingly at least partially translucent or transparent. In the depicted example, the light module component 8 further comprises a converter 81 for supplying power to the LED light source.

To assemble the light strip system, it can be intended accordingly, that after the installation of the mounting rail elements 1, 2, the before-mentioned shaped element 4 is arranged next, thereafter the light module component 8 and finally the accommodation space 6 is closed by means of a form-fit connection of the two shaped elements 4, 5—when observed from a regular view towards the longitudinal axis L. In this way it possible to arrange the light module component 8 inside the accommodation space 6 in a way that there is well suited protection against dust and moisture.

The term "light module component" 8 generally includes, in a broader range, all components which are used to operate the light strip system, thus e.g. cables for power supply of light modules or for the transmission of control signals, cable holders, converters, sensors and the like.

In order to hold the light module component 8, it is arranged so as to push against contact regions 11, 12 of the carrier arrangement on two opposite sides, with respective intermediate areas of the shaped element 4. It is thus possible—despite the at least partially flexible characteristics of the two before-mentioned shaped elements 4, 5 and thus of the accommodation space 6—to achieve a stable and reliable mounting of the light module component 8. In a way, the contacting areas 11, 12 form stable support elements for the mounting of the light module component 8. The light module component 8 is therefore preferably designed accordingly in a stable manner, i.e. in particular correspondingly stable or solid within a region that extends between the two contacting areas 11, 12. In the depicted example, the light module component 8 comprises a plate-shaped area.

By means of this design, it is furthermore advantageously possible that the light module component 8 can be generally arranged at any desired position—with respect to the longitudinal axis L. In other words, the end user is basically free to choose at which point along the carrier arrangement the light module component 8 is to be placed.

A particularly simple assembly of the light strip system can be achieved when the light module component 8 is arranged to be held at the shaped elements 4 by means of a clamping via a snap-on connection and, in particular, only by means of the snap-on connection. A particularly suitable design can hereby be, when the snap-on connection can be produced without the use of any tools.

A particularly suitable flow of the force for holding the light module component 8 or a particularly suitable support can be achieved when the contacting areas are formed by two ledges 11, 12 of the carrier arrangement that are facing each other, especially when the intermediate areas of the shaped element 4 are arranged with a direct contact to the contacting areas 11, 12 of the carrier arrangement.

In the depicted example, both ledges 11, 12 are formed by ledges of the two U-brackets 15, 16. A first of the two ledges 11 is thereby a ledge of the first U-bracket 15 and the corresponding second ledge 12 is a ledge of the second U-bracket 16. Accordingly, the two ledges 11, 12 are facing towards each other, or in the direction of the respective other U-bracket.

The flow of the force for the holding of the light module component 8 is thus guided as directly as possible from the fixing point of the light module component 8 throughout the shaped element 4 onto the carrier arrangement or the mounting rail elements 1, 2.

As mentioned before, the light strip system preferably comprises several light module components, whereby the mounting of the light module components is done analogous in each case. As it is furthermore illustratively indicated in FIG. 2, it is possible that the light module component in this sense can also alternatively or additionally refer to e.g. a cable holder 8'.

The cable holder 8' is used in particular to support cables 9, which are used for the power supply of the light module 8 and/or for the transmission of control signals; these cables 9 accordingly also run within the accommodation space 6 and are thus arranged in a protected manner.

In the depicted example, the cable holder 8' is preferably formed with reference to the flow of the force with a slight upwards bent when viewed in cross-section. As it can be derived from FIG. 2 by way of example, the light module 8 and the cable holder 8' are arranged partially in a way that they are overlapping when viewed along the longitudinal axis L in the depicted example, whereby the cable holder 8' is preferably arranged on top of the light module 8 within the relevant longitudinal portion.

Accordingly, two further ledges 11', 12' of the carrier arrangement are formed for the mounting of the cable holder 8' that face towards each other and which work and are shaped in the same way as the before-mentioned ledges 11, 12 that are also facing each other. These two further ledges 11', 12' that are facing towards each other can accordingly also be formed as ledges of the two U-brackets 15, 16, whereby the two further ledges 11', 12' that are facing towards each other are preferably formed above the before-mentioned two ledges 11, 12 that are facing towards each other.

With reference to the accommodation space 6, the shaped element 4 preferably comprises ledges 41, 41' for the mounting of the light module components 8, 8' that face towards the inside, in particular in the shape of a profiling 41, 41' that is formed on the shaped element 4. In the depicted example, two ledges 41 that face towards the inside are formed for the mounting of the light module 8 and two further ledges 41' that face towards the inside for the mounting of the cable holder 8'.

A particularly simple assembly of the initially mentioned shaped element 4 on the carrier arrangement can be achieved when the shaped element 4 is arranged to be held by means of a snap-on connection, in particular only by means of the snap-on connection. With reference to the accommodation space 6, the shaped element 4 therefore preferably comprises ledges 42 that face towards the outside, in particular in the shape of a further profiling 42 that is formed on the shaped element 4.

These ledges 42 that are facing towards the outside are preferably at least mainly and at least to some extent arranged opposite of the ledges 41, 41' which face towards the inside—in the depicted example they are opposite to the ledges 41' which face towards the inside, whereby the further ledges 42 are formed for the mounting of the shaped element 4 at the carrier arrangement. This produces a particularly advantageous flow of the force, which serves for the mounting of the shaped element 4 at the carrier arrangement, and also for the mounting of the corresponding light module component, in this case of the cable holder 8'. For this purpose, it can e.g. be provided that the ledges 42 that face towards the outside and the oppositely located ledges 41' that face towards the inside are created by means of a respective profiling which overlap in their vertical extensions.

When viewed along the longitudinal axis L, the accommodation channel 6 preferably stretches at least mainly across the total length $\lambda$ of the carrier arrangement, thus across the length of the mounting rail elements 1, 2. It can e.g. be intended that the length of the accommodation channel 6 corresponds to at least 80% of the overall length $\lambda$ of the carrier arrangement.

To achieve a suitable tightness of the accommodation space 6, it is preferably provided that the shaped element 4 extends as one piece at least mainly across the length of the mounting rail elements 1, 2 or across the entire length of the accommodation space 6, in particular also over the coupling joint 3. The same applies for the other shaped element 5. It is thus possible to produce a practically "continuous channel" by means of the two shaped elements 4, 5. Accordingly, the shaped elements 4, 5 can have relatively great lengths, such as e.g. lengths of more than 3 m, 5 m or also 10 m.

For the assembly, the carrier arrangement is so to say lined with the shaped element 4. Accordingly, there is practically no possibility to connect the light module components 8, 8' directly to the mounting rail elements 1, 2. But by means of the above mentioned design, it is possible to achieve a reliable mounting of the light module component 8, 8' despite a suitable tightness of the accommodation space 6.

Preferably, the shaped element 4 and possibly also the other shaped element 5 are designed in such a way that they can be rolled up into a reel. In this way, the shaped elements 4, 5—despite their lengths—can be transported in a particularly suitable manner, e.g. to an installation site of the light strip system. For example, it can be intended that the shaped element 4 can be rolled into a reel with a diameter that is less than 2 m—of course without being damaged. The same applies for the other shaped element 5.

In order to design the accommodation space 6 with a suitable tightness, it is preferably also sealed accordingly at its two end faces. It can e.g. be provided that the cables for the power supply of the light module 8 or for the transmission of control signals are arranged in such a way that they are led into the accommodation space 6 at an end face along with an appropriate tightness.

The accommodation space 6—preferably with reference to the protection of the components or light module components 8, 8' that are inside of it—is thus fully sealed. The light module components 8, 8' that are situated within the accommodation space 6 are therefore not subject to a correspondingly higher protection class. Corresponding requirements are only relevant with reference to the accommodation space 6 as such.

It is thus also possible to assemble the accommodation channel 6 in a particularly suitable way by an "end user" at the installation site. In particular, it is also possible to produce e.g. an electrical connection between the cables 9 and the light module 8, or in short the "wiring" in a relatively simple manner by the end user.

But due to the tightness of the accommodation space 6, there is a certain thermal stress: When temperature fluctuations occur, as it can happen in connection with the operation of the light strip system, pressure fluctuations can occur, in particular a negative pressure in the accommodation space 6, which has the potential of producing a suction effect which would be associated with an entry of dust or moisture into the accommodation space 6. In order to avoid this, it is preferably arranged that at least one of the shaped elements 4, 5 is designed in such a flexible manner that, in the case of a temperature-related change of the pressure within the accommodation channel 6, the pressure change can at least be compensated to the largest degree by an adapting of the shape of the corresponding shaped element 4, 5 or of the two shaped elements 4, 5. The shaped elements 4, 5 are designed accordingly, so that the flexible or elastic areas allow for an adapting of the cross-section of the accommodation space 6 without any big resistance.

Figure 4:
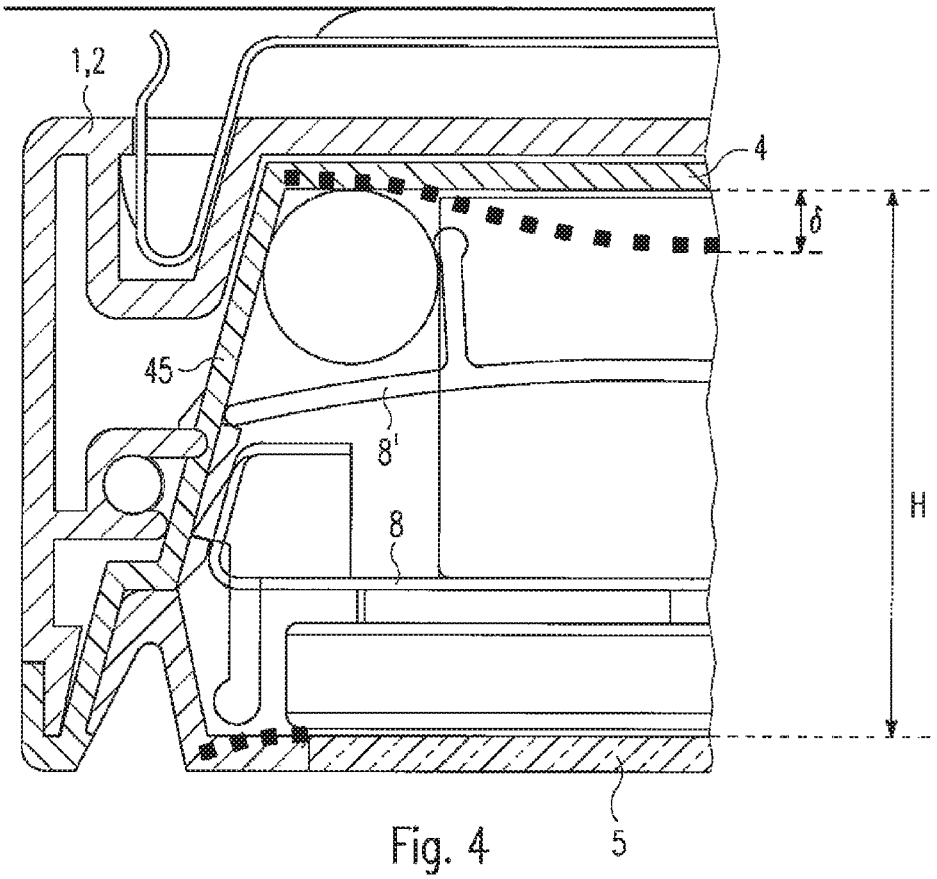
FIG. 4 shows a section corresponding to FIG. 3 with an indicated adapting of the shape of the two shaped elements that form the accommodation space.

In FIG. 4, a corresponding adapting of the shape of the shaped element 4 or of the further shaped element 5 is outlined by means of small squares.

In the depicted example, the shaped element 4—just like it was outlined in FIG. 2—comprises a base area 47 and two arm sections 45, 46 that adjoin the base area 47 on two opposite sides, whereby the base area 47 basically touches the connecting bracket 17 of the mounting rail elements 1, 2—during balanced pressure conditions. The base area 47 is hereby designed in such a flexible or elastic way, that it bends inside or downwards in the accommodation space 6, when a corresponding cooling occurs, so that the volume of the accommodation space 6 is thus reduced to such an extent, that virtually no negative pressure can form within the accommodation space 6, or at least only a negative pressure that is so small, that it does not produce any suction effect.

In this way, it is possible to prevent a suction effect by means of which dust or moisture could reach into the accommodation space 6. To achieve a suitable curvature, the base area 47 may be designed in a particularly more elastic or flexible manner than the arm sections 45, 46.

It can e.g. be intended that the shaped element 4 is designed in such a way that the base area 47 is shifted from a resting position, in which it is during balanced pressure conditions, by a distance 6 into the accommodation space 6 when a cooling occurs, which corresponds to at least 5% of the height H of the accommodation space 6.

Alternatively or additionally, the other shaped element 5 can basically be designed in the same manner. It is thus also possible to provide a correspondingly flexible or elastic area in this case as well. In the depicted example, the further shaped element 5 comprises a particularly translucent floor area 57 and two connecting areas 55, 56, which adjoin the floor area 57 on both sides. The floor area 57 can hereby be designed so that it can form a corresponding deformation.

The connecting areas 55, 56 may feature e.g. a respective U- or V-shaped cross-section, which is suitable for a form-fit connection with the shaped element 4. By means of the connecting areas 55, 56 it is particularly possible to form sealing lips for a correspondingly tight connection with the shaped element 4.

In the depicted shaping of the shaped element 4 it is preferably provided that the two arm sections 45, 46 can basically be bent into the plane of the base area—when the shaped element 4 is separated from the remaining light strip system; this enables a particularly suitable rollability of the shaped element 3.

The light strip system according to the invention is particularly well suited for usage in a dusty or moist environment, as it is the case in facilities that are e.g. used for industrial purposes. The light modules and also other components can hereby be mounted in a particularly simple and reliable manner on site, in principle at any desired location along the longitudinal axis of the carrier arrangement.

What is claimed is:

1. A light strip system comprising:

an elongated carrier arrangement, which is formed by mounting rail elements featuring at least partly a U-shaped cross section with an opening facing downward, the mounting rail elements being joined together end to end to extend in a longitudinal direction, said rail elements including at least one inwardly facing contact area on each side, a first shaped element which comprises a flexible material in order to form part of an accommodation space within the elongated carrier arrangement, said first shaped element extending in the longitudinal direction, a second shaped element, which is connected to the first shaped element in order to seal the accommodation space, said second shaped element extending in the longitudinal direction and including a floor area that is translucent or transparent, and a light module component which is arranged inside the accommodation space, wherein in order to hold the light module component, the light module component pushes against the contact areas on each side of the rail elements of the carrier arrangement, with respective flexible, intermediate areas of the first shaped element between the light module component and the respective contact area.

2. The light strip system according to claim 1, wherein the light module component is arranged to be held by clamping onto the first shaped element via a snap-on connection.

3. The light strip system according to claim 1, wherein the accommodation space is sealed fully tight.

4. The light strip system according to claim 1, wherein the contacting areas are formed by means of two pairs of ledges of the carrier arrangement that are facing towards each other.

5. The light strip system according to claim 1, wherein the intermediate areas of the shaped element are arranged in such a way that they directly touch the contacting areas of the carrier arrangement.

6. The light strip system according to claim 1, wherein the first shaped element is attached to the carrier arrangement by means of a snap-on connection.

7. The light strip system according to claim 1, wherein the first shaped element comprises at first set of ledges that face towards the inside for the mounting of the light module component.

8. The light strip system according to claim 6, wherein the first shaped element further comprises ledges that face towards the outside for the mounting of the shaped element at the carrier arrangement.

9. The light strip system according to claim 1, wherein the first shaped element extends as one piece at least essentially across the length of the mounting rail elements.

10. The light strip system according to claim 1, wherein the second shaped element is connected to the first shaped element with a form-fit in order to form and seal the accommodation space.

11. The light strip system according to claim 1, wherein the first shaped element is configured to be rolled up into a reel.

12. The light strip system according to claim 1, wherein the light module component is a light module or a cable holder that is bow-shaped in one cross-section.

13. A light strip system according to claim 10 wherein:

at least one of the first and second shaped elements is configured with sufficient flexibility and the accommodation space has sufficient clearance so that, in the case of a temperature-related change of the pressure within the accommodation space, the pressure change can be compensated by an adapting of the shape of the corresponding shaped element.

14. The light strip system according to claim 13, wherein the accommodation space is sealed in a fully tight manner.

15. The light strip system according to claim 7, wherein the first shaped element comprises a second set of ledges that face towards the inside for the mounting of a cable holder.

* * * * *